US006341208B1

(12) United States Patent
Liu et al.

(10) Patent No.: US 6,341,208 B1
(45) Date of Patent: Jan. 22, 2002

(54) ABSORBENT COATING FOR CONTACT TRANSFER OF LIQUID TONER IMAGES

(75) Inventors: Chu-heng Liu, Penfield; Weizhong Zhao, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/604,514

(22) Filed: Jun. 27, 2000

Related U.S. Application Data

(63) Continuation-in-part of application No. 09/232,814, filed on Jan. 19, 1999.

(51) Int. Cl.[7] ..... G03G 15/10
(52) U.S. Cl. ..... 399/237; 430/112; 430/126
(58) Field of Search ..... 399/237, 249, 399/297, 308, 318; 430/112, 126, 114–119

(56) References Cited

U.S. PATENT DOCUMENTS

| | | | | | |
|---|---|---|---|---|---|
| 3,954,640 | A | * | 5/1976 | Lu et al. | 252/62.1 L |
| 4,507,377 | A | * | 3/1985 | Alexandrovich | 430/115 |
| 4,659,640 | A | * | 4/1987 | Santilli | 430/119 |
| 5,521,037 | A | * | 5/1996 | Nagase et al. | 430/126 |
| 5,592,269 | A | * | 1/1997 | Younes et al. | 399/237 |
| 5,608,503 | A | * | 3/1997 | Fujiwara et al. | 399/237 X |
| 5,688,624 | A | * | 11/1997 | Chamberlain et al. | 430/115 |
| 5,723,251 | A | * | 3/1998 | Moser | 430/126 |

* cited by examiner

*Primary Examiner*—William J. Royer
(74) *Attorney, Agent, or Firm*—Oliff & Berridge, PLC

(57) ABSTRACT

The efficient contact transfer of liquid toner images is obtained by using an absorbent coating material over an image bearing member. The absorbent coating material absorbs carrier fluid from a developed image. By absorbing carrier fluid from the developed image the internal cohesiveness of the image increases and the adhesion of the image to the next substrate increases.

33 Claims, 2 Drawing Sheets

ABSORBENT COATING FOR CONTACT TRANSFER OF LIQUID TONER IMAGES

This is a Continuation-in-Part of application Ser. No. 09/232,814 filed Jan. 19, 1999. The entire disclosure of the prior application(s) is hereby incorporated by reference herein in its entirety.

BACKGROUND OF THE INVENTION

1. Field of Invention

This invention is directed to contact transfer of liquid toner images.

2. Description of Related Art

Efficient contact transfer of a toner image from a first substrate to a second substrate without the assistance of an electrostatic field or heat has not yet been possible using conventional printers or inks. Efficient contact transfer requires that the toner image must adhere better to the second substrate than to the first substrate and the toner image must also be cohesive enough to prevent distortion of the image. However, conventional liquid toners do not have the material properties necessary to meet these requirements because other subsystems such as development, cleaning and replenishment systems require toners with conflicting material properties.

SUMMARY OF THE INVENTION

This invention provides methods and systems that efficiently transfer liquid toner images using an absorbent coating under the toner image. The absorbent coating absorbs carrier fluid from the toner image. The absorption of the carrier fluid increases the solid content of the toner image. When a phased-film-forming ink is used, the removal of fluid increases the cohesiveness of the toner image and makes the toner image ready to be transferred at ambient temperature with simple pressure contact.

The systems and methods of the invention include developing a latent image with a phased-film-forming ink or self-fixing ink and conditioning the ink by absorbing carrier fluid from the ink using an absorbent coating over an image bearing member. Conditioning the image using an absorbent coating increases the developed image's internal cohesion and/or makes the developed image sufficiently adhesive by increasing the solid content of the ink. The ink image quickly reaches a high solid content due to the loss of carrier fluid to the absorbing substrate. This conditioned image is suitable for contact transfer.

Additionally, the carrier fluid in the absorbent coating can be released during the transfer and may serve as a release layer for releasing the developed image from the image bearing member.

The methods and systems of this invention do not require additional image conditioning to provide a highly efficient transfer. Additionally, the systems and methods of this invention enable an image with a very high solid content to be transferred and provide a very high quality transfer that is comparable to conventional transfix methods but at a much lower temperature. Additionally, the systems and methods of this invention have a large latitude for process control, such as the solid content, the process pressure, the process temperature and the like.

While the methods and systems of this invention may benefit from an electrostatic method and/or system to assist in the transfer of the toner image, the methods and systems of this invention provide for more effective toner image transfer with electrostatic voltages and are equivalent or lower than that typically provided for conventional electrostatic transfer processes.

These and other features and advantages are described in or are apparent from the following detailed description of the preferred embodiments.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
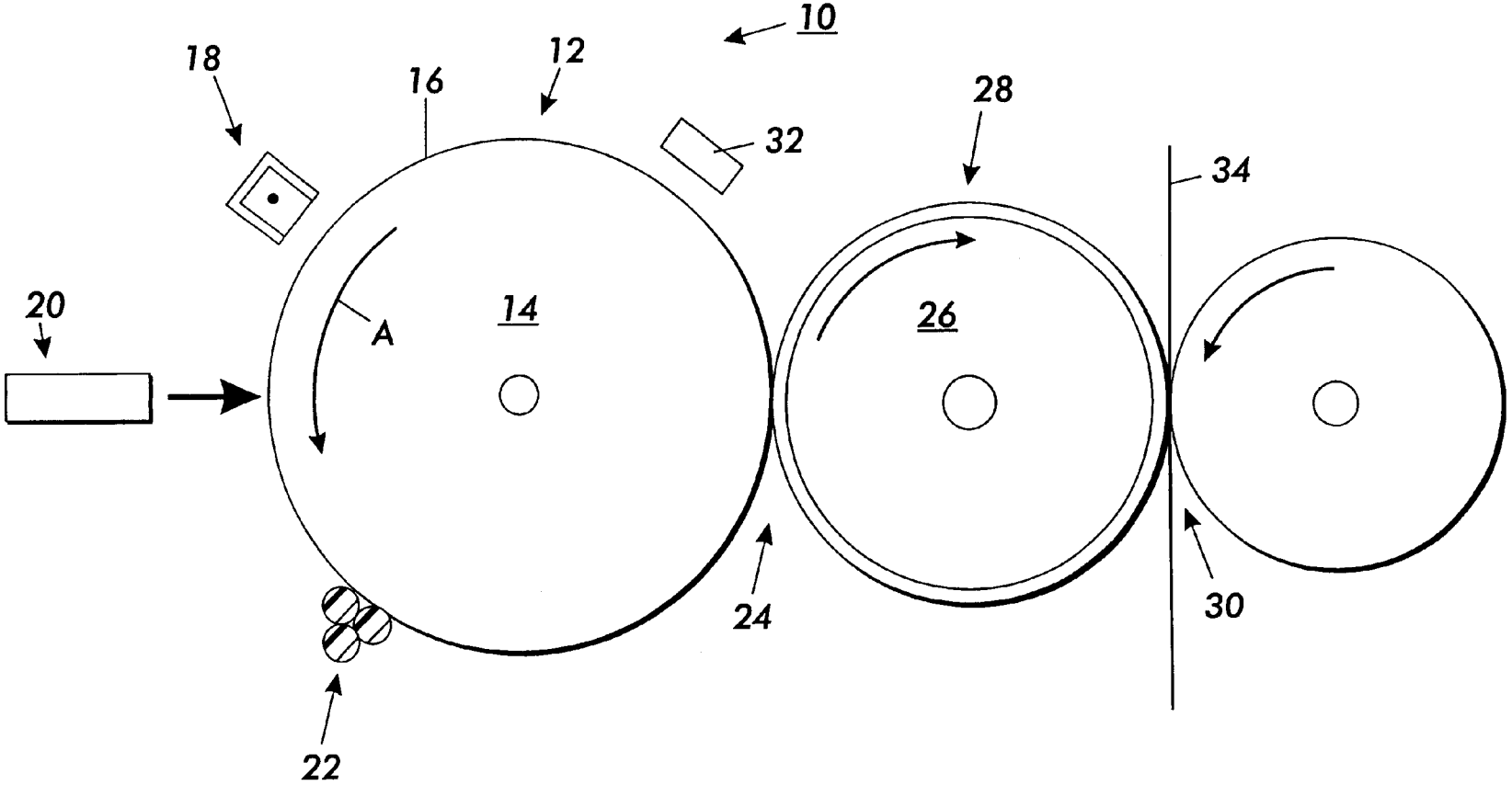
FIG. 1 is a schematic diagram of an image forming device in accordance with an embodiment of the invention.

The methods and systems of this invention use an absorbent material which removes carrier fluid to condition a toner image for contact transfer. Liquid toner images comprise carrier liquid and toner particles. The toner particles typically contain pigments as well as other materials such as charge control agents bound in a polymeric resin. Depending upon the compatibility of the carrier liquid and the resin, the toner particles may swell, by absorbing the carrier liquid, to varying degrees. If the resin particles swell to such an extent that the toner particle boundaries are not well defined, then the cohesiveness of the toner image tends to be relatively high at high toner concentrations. Additionally, as the ratio of toner particles to carrier fluid increases the cohesiveness of the toner image also increases. The toner particles tend to combine or interact more with each other as the relative concentration of the toner particles increases. A typical toner resin will swell by absorbing the carrier fluid. Thus, swelling is a function of the compatibility between the resin and the carrier fluid.

An incompatible combination of the carrier fluid and toner resin will produce a toner suspension with toner particles distinctly distinguishable from the carrier fluid with sharp boundaries between the toner particles and between the toner particles and carrier fluid. When the fluid is removed at ambient temperature, in this case, the toner will dry to a power-like texture with extremely weak bonds between the constituent toner particles. One such example of such a toner and carrier fluid combination includes a polyester-based resin in an Isopar carrier fluid, where Isopar is produced by Exxon.

On the other hand, when the resin and the carrier fluid are very compatible, such as ELVAX resin (a registered trademark of DuPont referring to various ethylene-vinyl acetate copolymer resins) in an ISOPAR (a registered trademark of Exxon referring to various aliphatic isomerized hydrocarbons also known as isoparaffinic hydrocarbons) carrier fluid, the resin swells substantially, such that the boundaries between the toner particles and the fluid are less distinct. If the carrier fluid is subsequently removed, the swollen toner particles are brought closer together and the boundaries between the swollen toner particles slowly disappear. The toner, in effect, changes state from a suspension of distinct particles to a "soupy" state, i.e., an adhesive and cohesive unitary entity. When the resulting toner soup dries, it forms a film. Toners like this are referred herein as "phased-film-forming" inks.

The phase-changing capacity of phased-film-forming inks from particle form to unitary form provides several advantages over conventional toners. For example, while particle-based toner and carrier fluid combinations such as the polyester-based toner mentioned above, can be precisely controlled to form clear images relative to unitary inks, the particle-based toners cannot adequately adhere to a substrate without applying heat to melt the toner particles to the substrate.

On the other hand, while various conventional unitary inks can adhere to a substrate without applying heat, such conventional unitary inks cannot be precisely placed on the substrate as the conventional unitary inks tend to smear across desired boundaries.

However, because phased-film-forming inks start in a particle state, the phased-film-forming inks can be precisely placed, without smearing. Thus, the phased-film-forming inks can form high quality images. Furthermore, because phased-film-forming inks change state from particle form to unitary form as the carrier fluid is removed, phased-film-forming inks can subsequently display the adhesive and cohesive properties, not found in particle-based toners, that allow the phased-film-forming ink to securely attach to a substrate.

In order to enable contact transfer of a toner image from a first substrate to a second substrate, the toner used to form the image must exhibit a higher adhesiveness to the second substrate than to the first substrate and the toner used to form the image must also be cohesive enough to prevent the toner image from breaking, separating or otherwise becoming distorted during the transfer.

Liquid toner images have conventionally been transferred onto substrates using electrostatic transfer or transfuse methods. Electrostatic transfer processes can overcome an adhesiveness of a toner image to a first substrate by applying a voltage differential between a second substrate and the toner image. Typically, these electrostatic processes require a strong electrical field and a voltage differential on the order of 800 volts or greater. However, process control for electrostatic transfer is very narrow. In particular, solid content, developed mass per unit area, substrate range and other factors that affect the efficiency of the transfer are difficult to control. Additionally, transfer quality using electrostatic transfer is difficult to maintain.

Electrostatic transfer processes can also involve coating paper with carrier fluid. The layer of carrier fluid smoothes the surface of the paper to prevent air from becoming trapped beneath the toner image. However, it can be difficult to remove the carrier fluid from the paper, electrostatic transfer without coating the paper with carrier fluid has been ineffective because air bubbles trapped between the toner image and the paper prevent adequate transfer.

At ambient temperature, toners that are typically used for transfuse processes tend to have resin particles that have distinct boundaries and do not swell much in the carrier fluid. Thus, the cohesiveness between the toner particles at ambient temperature is relatively low. Transfuse processes heat the toner image above the melting or solvating point of the resin particles. Above this temperature, the resin particles tend to mix with adjacent resin particles and the carrier liquid and form a complex fluid that has the proper cohesive and adhesive characteristics for contact transfer.

While transfuse and/or transfixing processes result in a higher quality image than electrostatic transfer, because the transfuse process requires heat, many problems are encountered in controlling the effects of the heat. For example, registration is problematic because the dimensions of the components of a system vary due to the thermal expansions and contractions that result from heating and cooling the system components. Additionally, transfixing requires generating heat, and thus controllably dissipating the heat, which requires additional processing time and/or elaborate heat transfer systems. Additionally, other processes may not be usable with a transfix method because these other processes may not react well to the heat.

Marking systems that use transfix and/or transfuse systems require an image bearing member that has a low surface energy and a conformable surface. However, it is difficult to provide a latent image bearing member, such as a photoreceptor, that meets these constraints for a typical marking system. Therefore, after a toner image is formed on a latent image bearing member in these systems, a strong electrostatic transfer process is used to move the toner image from the latent image bearing member to an intermediate image bearing member having a low surface energy. An electrostatic transfer process is usable with the intermediate image bearing member because of the smoothness of the surface of the intermediate image bearing member.

Next, the toner image is transfixed from the intermediate image bearing member to a recording media such as paper. Because the intermediate image bearing member has a low surface energy, the toner image adheres to the recording media better than it adheres to the intermediate image bearing member. Additionally, the toner image is cohesive enough to prevent separation of the toner image because the image has been transfixed through the application of heat and the resultant melting and/or solvating of the toner resin.

One exemplary embodiment of the systems and methods of this invention uses a low surface energy material as an image bearing member. Examples of low surface energy image bearing members are described in U.S. Pat. Nos. 5,567,765, 5,576,818, and 5,585,905, each incorporated herein by reference in its entirety. While the following detailed description refers to low surface energy image bearing members, it should be understood that the methods and systems of the invention are also applicable to other types of image bearing members. Additionally, it should be understood that the methods and systems of the invention are useful for contact transfer from many types of image bearing members, such as an imaging member, an intermediate transfer member or any other known or later developed image bearing member.

Low surface energy refers to a surface of a solid which has a low interfacial free energy between the image bearing member and the developed image. A low interfacial free energy means that the solid will not adhere well to the image. Therefore, it may be easy to transfer the image to a new substrate. The methods and systems of the invention condition the developed image by increasing the solid content using an absorbent material. This increases the adhesiveness of the developed image to next substrate and/or increases the internal cohesiveness of the developed image, so that the developed image will transfer efficiently to the next substrate.

The absorbent material has at least two advantages. The developed image quickly reaches a high solid content due to the loss of the carrier fluid into the absorbent material. As discussed above, with inks such as a phased-film-forming ink or a self-fixing ink, when such an ink has a high solid content, the toner changes phase from a collection of individual particles to a toner "soup". Thus, at high solid content for such inks, the conditioned image is immediately suitable for transfer at ambient temperature. The developed image is highly internally cohesive. This allows the developed image to maintain its integrity. At the same time, the exposed surface of the image that contacts the next substrate, such as paper or any other known or later developed substrate, becomes extremely adhesive.

The absorbent material also may release some of the carrier fluid under high pressure at the transfer nip. The released carrier fluid assists in releasing the developed image from the image bearing member.

In one exemplary embodiment of the systems and methods of this invention, the image conditioning increases the solid content of the liquid toner image. For example, the developed image can be conditioned to have a 20% or higher solid content. A phased-film-forming ink at this concentration will be very sticky and tacky and will, therefore, be suitable for pressure contact transfer. Thus, a high quality transfer of the developed image from an image bearing member to another substrate can be achieved.

FIG. 1 shows one exemplary embodiment of an image forming device 10. The image forming device 10 includes a drum 12 having an electrically grounded conductive substrate 14. A photoconductive layer 16 is provided over the electrically grounded conductive substrate 14. Processing stations are positioned about the drum 12, such that, as the drum 12 rotates in a direction of arrow A, the drum 12 transports a portion of the photoconductive surface of the photoconductive layer 16 sequentially through each of the processing stations. The drum 12 is driven at a predetermined speed relative to the other machine operating mechanisms by a drive motor (not shown). Timing detectors (not shown) sense the rotation of the drum 12 and communicate with a control system (not shown) to synchronize the various operations of the image forming device, so that the proper sequence of operations is produced at each of the respective processing stations. In an alternative exemplary embodiment, a photoreceptor belt may be used as the image forming device 10 instead of the drum 12. In general, any known or later developed photoreceptor device or structure may be used in place of the drum 12.

Initially, the drum 12 rotates the photoconductive layer 16 past a charging station 18 that charges the surface of the photoconductive layer 16. The charging station 18 may, for example, be a corona generating device or any other known or later developed charging device. As a corona generating device, the charging station 18 sprays ions onto the photoconductive surface of the photoconductive surface 16 to produce a relatively high, substantially uniform charge on the photoconductive layer 16. As known in the art, the photoconductive layer 16 must be of sufficient thickness and dielectric constant to have sufficient capacitance to develop the image-wise charge to a sufficient optical density.

Once the photoconductive layer 16 is charged, the drum 12 rotates to an exposure station 20, where an image of an original image is projected onto the charged photoconductive layer 16 to form a latent image on the photoconductive layer 16. The exposure station 20 may include a laser raster output scanner, a modulated laser beam, ion beams or any other known or later developed system or apparatus for forming a latent image on the charged photoconductive surface 16.

As the drum 12 continues rotating, the drum 12 rotates the latent image formed on the photoconductive surface 16 to a developer bath station 22. In the developer bath station 22, a liquid developer including a phased-film-forming ink or self-fixing ink is applied to the latent image. The toner particles in the ink are attracted to the latent image on the photoconductive layer 16. The toner particles move through the carrier liquid in an image-wise manner to the latent image formed on the photoconductive layer 16.

Following the developer bath station 22, the drum 12 continues rotating to a transfer station 24 that includes an intermediate image bearing member 26. The intermediate image bearing member 26 has an absorbent layer 28. The image is transferred from the drum 12 onto to intermediate image bearing member 26. The absorbent layer 28 absorbs at least a portion of the carrier liquid in the developed image. Absorbing the carrier fluid from the developed image increases the solid content of the developed image. As discussed above, increasing the solid content of the developed image increases the adhesiveness and/or the internal cohesiveness of the developed image.

The intermediate image bearing member 26 rotates to a transfer station 30 that includes a conductive pressure roller 32. The pressure roller 32 may have a surface of conductive rubber or the like. A copy sheet 34 also advances into the transfer station 30. The pressure roller 32 applies pressure to the copy sheet 34 to press the copy sheet 34 against the developed image on the intermediate image bearing member 26. While the copy sheet 34 proceeds between the pressure roller 32 and the intermediate image bearing member 26, an optional voltage potential may be applied between the intermediate image bearing member 26 and the pressure roller 32, as is known in the art. The voltage potential applied to the pressure roller 32 aids in transferring the developed toner image to the copy sheet 34.

The systems and methods of this invention involve conditioning the developed image to make the toner image suitable for contact transfer, by using the absorbent layer 28 on the image bearing member 26. The absorbent coating absorbs sufficient carrier liquid to increase the internal cohesiveness of the developed image to maintain its integrity during transfer and/or to increase the adhesiveness of the developed image to the next substrate. After image conditioning using the absorbent layer, the developed image can be transferred through simple contact with the next substrate.

Figure 2:
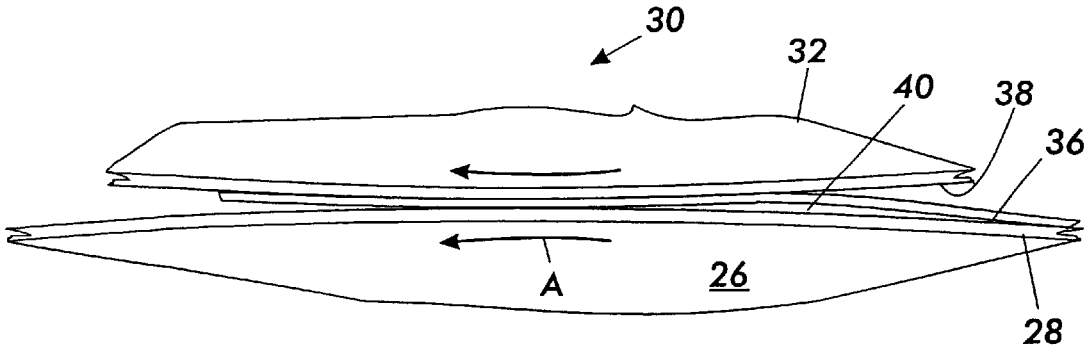
FIG. 2 is an enlarged view and the transfer nip between an image bearing member having an absorbent coating in accordance with the invention and a pressure roller.

FIG. 2 shows an enlarged view of the transfer station 30 between the intermediate image bearing member 26 and the pressure roller 32. FIG. 2 shows the developed image 36 placed over the absorbent layer 28 as the intermediate image bearing member 26 rotates into the transfer station 30. FIG. 2 also shows a recording medium 38 on the pressure roller 32.

As shown in FIG. 2, prior to entering the transfer station 30, the absorbent layer 28 is swollen with carrier fluid that has been absorbed from the developed image 36. As the intermediate image bearing member 26 rotates into the transfer station 30, the pressure between the intermediate image bearing member 26 and the pressure roller 32 compresses the absorbent layer 28 and forces the absorbent layer 28 to release a portion of the carrier fluid. The carrier fluid creates a gap 40 between the developed image 36 and the absorbent layer 28. The carrier fluid in the gap 40 serves as a release layer to further encourage the developed image 36 to release from the intermediate image bearing member 26 and to transfer to the recording medium 38.

Optionally, the developed image 36 may be fused (or fixed) on the recording medium 38 after the developed image 36 is transferred.

After the developed image 36 is transferred, the intermediate image bearing member 26 may continue rotating to a carrier fluid collection station (not shown) which removes the carrier fluid from the absorbent layer 28 before the next cycle begins.

In another exemplary embodiment of the methods and systems of this invention, an electrostatic field may be used to assist the image transfer. In this exemplary embodiment, an electrostatic bias is applied between the intermediate image bearing member and the next substrate. This bias assists the transfer because the developed image is charged. Therefore, the developed image is attracted to the next substrate because of this charge. The electrostatic voltage differential for this exemplary embodiment does not need to be as high as is necessary for conventional electrostatic systems that do not use an absorbent coating in accordance with this invention.

As discussed above, the various choices for particle resins and carrier fluids will depend in part on their compatibility. Generally, the more easily carrier fluid is absorbed by a particle resin, i.e., the higher the solvation between a particular resin and carrier fluid and thus, the more likely the resin and carrier fluid will form a phased-film-forming ink. On the other hand, if a particular resin goes completely into solution, i.e., the resin and carrier fluid are too compatible, the toner becomes a unitary ink that cannot be adequately controlled to form smear-free images for the reasons outlined above with respect to conventional unitary inks. Accordingly, resins and carrier fluids should be selected such that the resins exhibit substantial solvation, but do not go into solution.

For a given carrier fluid, the compatibility of a given resin will depend on a number of factors, including the molecular structure of the resin as well as the molecular weight of the resin. For example, DuPont produces a variety of resins having different molecular structures such as its "Elvax" and "RX" families. DuPont further produces a variety of Elvax and RX resins having different molecular weights. For example, the Elvax resin family contains a large number of variants including Elvax 200, Elvax 300 and Elvax 500, which differ primarily in their molecular weights.

Table 1 shows various operable temperature ranges for a number of toners having various different resins combined with an Isopar carrier. Table 1 presents the operable temperatures for three variations of Elvax, a single variant of RX and a Elvax/RX hybrid, all in an Isopar carrier fluid.

TABLE 1

| Toner Resin | Toner Concentration | Minimum Temp (Smooth Substrate) | Minimum Temp (Rough Substrate |
|---|---|---|---|
| Elvax 200 | 25%–65% | ~25° C. | ~25° C. |
| Elvax 300 | ~35% | ~25° C. | ~50° C. |
| Elvax 500 | ~50% | ~70° C. | ~70° C. |
| RX-76 | ~50% | ~100° C. | ~100° C. |
| Elvax 200/RX-76 (50/50) | ~50% | ~60° C. | ~60° C. |

The first toner resin, Elvax 200, has the lowest molecular weight of the Elvax family and can be more precisely described as an ethylene-vinyl acetate (EVA) copolymer resin having a 28% vinyl acetate concentration with a melt index of $2.5\times10^3$ dg/min. Because of its compatibility with an Isopar-based carrier fluid in part on its molecular weight, a wide range of toner concentrations (25%–65%) can be used to produce quality images at typical room temperatures, i.e., from ~25° C. to ~35° C.

The second entry, Elvax 300, can be described as an EVA copolymer resin having a 25% vinyl acetate concentration with a melt index of $2.5\times10^3$ dg/min. Elvax 300 has similar molecular structure to Elvax 200, but has a higher molecular weight. Consequently, the Elvax 300 resin is less compatible with the Isopar carrier fluid than the Elvax 200 resin. As a result, the range of acceptable toner concentration is much narrower (~35%). For room temperatures (~25° C.), the Elvax 300-based phased-film-forming ink can produce quality images only on smooth substrates, such as fine-grained or coated paper. For coarser substrates such as various textured papers, the temperature must be raised to a minimum of about 50° C.

The third resin, Elvax 500, is an EVA copolymer resin having a vinyl acetate content of 14% and a melt index of $2.5\times10^3$ dg/min. Elvax 500, does not produce acceptable images at room temperature regardless of the toner concentration. However, experimentation did reveal that an Elvax 500-based phased-film-forming ink can produce acceptable images on both smooth and rough substrates for temperatures at least as low as 70° C.

The fourth resin, RX-76, is a copolymer of ethylene and methacrylic acid with a melt index of about 800 dg/min. RX-76, is less compatible with the Isopar carrier fluid than any of the Elvax resins. Consequently, as shown in Table 1, an RX-76-based toner can only produce acceptable images at minimum temperatures of about 100° C.

The last resin is a hybrid resin mixture of 50% Elvax 200 and 50% RX-76 in an Isopar-based carrier fluid with a total toner concentration of about 50%. The resulting toner produced no acceptable images at room temperature but did produce acceptable images at temperatures starting at 60° C., 40° C. lower than the pure RX-76 toner.

As shown in Table 1, the particular selection of a resin will be a design choice based on a selected carrier fluid and the level of compatibility that particular resin demonstrates with the selected carrier fluid. In general, it should be appreciated that the selected resin can be any known or later developed resin that demonstrates acceptable levels of compatibility with the selected carrier fluid such that the resulting toner is substantially a suspension of particles at a first concentration, but changes state to form a toner/carrier liquid combination that is close to, but not completely, a unitary ink, as the selected carrier fluid is removed.

Similarly, the carrier fluid can be any known or later developed carrier fluid that displays acceptable compatibility with a selected resin to produce a toner that is substantially a suspension of resin particles at a first concentration, but that changes state to form a toner/carrier liquid combination that is close to, but not completely, a unitary ink as the carrier fluid is removed.

While this invention has been described in conjunction with the specific embodiments outlined above, it is evident that many alternatives, modifications and variations are apparent to those skilled in the art. Accordingly, the preferred embodiments of the invention as set forth above are intended to be illustrative and not limiting. Various changes may be made without departing from the spirit and scope of this invention.

What is claimed is:

1. A method for contact transferring a toner image from an image bearing member to a substrate, comprising:

placing a toner image over an image bearing member having an absorbent layer, the toner image comprising toner particles suspended in a carrier liquid;

absorbing carrier liquid from the toner image into the absorbent layer;

transferring the toner image to the substrate;

wherein the steps of absorbing and transferring occur between the temperatures of about 25° C. and about 35° C.; and wherein the toner image comprises a phased-film-forming ink.

2. The method of claim 1, wherein the steps of absorbing and transferring occur without applying heat.

3. The method of claim 1, wherein the phased-film-forming ink has a toner particle concentration from about 25% to about 65%.

4. The method of claim 1, wherein the toner particles are formed using an ethylene-vinyl acetate resin.

5. The method of claim 4, wherein the toner particles are formed using an ethylene-vinyl acetate copolymer resin having about a 28% vinyl acetate concentration with a melt index of about $2.5\times10^3$ dg/min.

6. The method of claim 4, wherein the carrier liquid is an isoparaffinic hydrocarbon-based carrier fluid.

7. The method of claim 4, wherein the toner particles comprise an ethylene-vinyl acetate resin and at least one other resin.

8. The method of claim 1, wherein the absorbent layer is a low surface energy material.

9. The method of claim 8, wherein the absorbent layer is a silicone-based material.

10. The method of claim 1, further comprising generating a latent image over the image bearing member before applying the toner image.

11. The method of claim 1, wherein transferring the toner image comprises pressing the substrate against the image bearing member.

12. The method of claim 11, wherein the transferring the toner image comprises, in response to pressing the substrate against the image bearing member, releasing carrier liquid from the absorbent layer.

13. The method of claim 1, further comprising, in response to absorbing carrier liquid from the toner image, increasing an internal cohesion of the toner image.

14. The method of claim 1, further comprising, in response to absorbing carrier liquid from the toner image, increasing an adhesiveness of the toner image.

15. The method of claim 1, wherein placing the toner image over the image bearing member comprises forming the toner image over the image bearing member.

16. The method of claim 1, further comprising forming a latent image over the image bearing member, wherein placing the toner image over the image bearing member comprises developing the latent image.

17. The method of claim 1, further comprising forming the toner image a photoreceptor, wherein placing the toner image over the image bearing member comprises transferring the toner image from the photoreceptor to the image bearing member.

18. An image forming system comprising:

an image bearing member;

an absorbent layer formed over the image bearing member;

a toner image applicator that places a toner image over the image bearing member, the toner image comprising toner and a carrier liquid, the absorbent layer capable of absorbing the carrier liquid from the toner image, wherein the toner image comprises a phased-film-forming ink; and wherein the image forming system operates between the temperatures of about 25° C. and about 35° C.

19. The image forming system of claim 18, wherein the system does not apply heat to the toner image.

20. The image forming system of claim 18, wherein the phased-film-forming ink has a toner particle concentration from about 25% to about 65%.

21. The image forming system of claim 18, wherein the toner particles are formed using an ethylene-vinyl acetate resin.

22. The image forming system of claim 21, wherein the toner particles are formed using an ethylene-vinyl acetate copolymer resin having about a 28% vinyl acetate concentration with a melt index of about $2.5\times10^3$ dg/min.

23. The image forming system of claim 21, wherein the carrier liquid is an isoparaffinic hydrocarbon-based carrier fluid.

24. The image forming system of claim 18, wherein the toner particles comprise an ethylene-vinyl acetate copolymer resin and at least one other resin.

25. The image forming system of claim 18, wherein the absorbent layer is a low surface energy material.

26. The image forming system of claim 25, wherein the absorbent layer is a silicone-based material.

27. The image forming system of claim 18, further comprising a transfer station that is capable of transferring the toner image to a substrate.

28. The image forming system of claim 27, wherein the transfer station is capable of pressing the substrate against the image bearing member.

29. The image forming system of claim 28, wherein, in response to pressing the substrate against the image bearing member, the absorbent layer releases the carrier liquid.

30. The image forming system of claim 18, wherein, in response to the absorbent layer absorbing carrier liquid, an internal cohesion of the toner image increases.

31. The image forming system of claim 18, wherein, in response to the absorbent layer absorbing carrier liquid, an adhesiveness of the toner image increases.

32. The image forming system of claim 18, further comprising an image-wise exposing system that is capable of forming a latent image over the image bearing member, wherein the toner image applicator is a latent image developing device.

33. The image forming system of claim 30, further comprising a photoreceptor, the toner image formed over the photoreceptor, wherein:

the image bearing member is an intermediate transfer member; and the toner image applicator is a transfer device that is capable of transferring the toner image from the photoreceptor to the image bearing member.

* * * * *